US009754749B2

(12) United States Patent
Son

(10) Patent No.: US 9,754,749 B2
(45) Date of Patent: Sep. 5, 2017

(54) MAGNETIC SWITCH

(71) Applicant: LSIS CO., LTD., Anyang-si, Gyeonggi-do (KR)

(72) Inventor: Sol San Son, Pohang-si (KR)

(73) Assignee: LSIS CO., LTD., Anyang-si (KR)

( * ) Notice: Subject to any disclaimer, the term of this patent is extended or adjusted under 35 U.S.C. 154(b) by 0 days.

(21) Appl. No.: 14/749,378

(22) Filed: Jun. 24, 2015

(65) Prior Publication Data

US 2016/0012995 A1 Jan. 14, 2016

(30) Foreign Application Priority Data

Jul. 11, 2014 (KR) ..... 10-2014-0087645

(51) Int. Cl.
*H01H 3/00* (2006.01)
*H01H 50/56* (2006.01)
(Continued)

(52) U.S. Cl.
CPC ..... *H01H 50/56* (2013.01); *H01F 7/0278* (2013.01); *H01H 50/04* (2013.01); *H01H 50/18* (2013.01);
(Continued)

(58) Field of Classification Search
CPC ..... H01H 50/04; H01H 50/18; H01H 50/44; H01H 50/56; H01H 50/64; H01H 50/645;
(Continued)

(56) References Cited

U.S. PATENT DOCUMENTS 1,436,639 A * 11/1922 Bindschedler ..... 335/262
2,021,822 A * 11/1935 Whitney ..... H01H 43/28 335/61
(Continued)

FOREIGN PATENT DOCUMENTS

CN 1969355 5/2007
CN 102194611 9/2011
(Continued)

OTHER PUBLICATIONS

European Patent Office Application Serial No. 15173223.7, Search Report dated Dec. 21, 2015, 8 pages.
(Continued)

*Primary Examiner* — Shawki S Ismail
*Assistant Examiner* — Lisa Homza
(74) *Attorney, Agent, or Firm* — Lee, Hong, Degerman, Kang & Waimey

(57) ABSTRACT

A magnetic switch includes: a housing; a cylinder coupled to an inner side of the housing; a stationary contact arm coupled to the housing; a movable contact arm positioned to be movable within the housing and brought into contact with the stationary contact arm or separated therefrom; a coil assembly installed within the housing and configured to form a magnetic field when a current is applied thereto; a movable shaft coupled to the movable contact arm in an upper portion thereof; a fixed core inserted into the cylinder and surrounding the movable shaft; and movable cores fixed to the movable shaft and configured to press the movable shaft by a magnetic field formed by the coil assembly to move the movable shaft.

6 Claims, 6 Drawing Sheets

(51) Int. Cl.

| | |
|---|---|
| ***H01H 50/04*** | (2006.01) |
| ***H01H 50/44*** | (2006.01) |
| ***H01F 7/02*** | (2006.01) |
| ***H01H 50/18*** | (2006.01) |
| ***H01H 50/64*** | (2006.01) |
| ***H01H 50/20*** | (2006.01) |
| ***H01H 51/06*** | (2006.01) |
| *H01H 36/00* | (2006.01) |

(52) U.S. Cl.
CPC ..... *H01H 50/20* (2013.01); *H01H 50/44* (2013.01); *H01H 50/645* (2013.01); *H01H 51/065* (2013.01); *H01H 2036/0086* (2013.01)

(58) Field of Classification Search
CPC ..... H01H 9/44; H01H 9/443; H01H 9/446; H01H 73/18; H01F 7/02; H01F 7/0278
USPC ..... 335/185
See application file for complete search history.

(56) References Cited

U.S. PATENT DOCUMENTS

| | | | | | |
|---|---|---|---|---|---|
| 2,407,603 | A * | 9/1946 | Derungs | H01F 7/13 | 335/177 |
| 2,407,963 | A * | 9/1946 | Persons | H01F 7/13 | 335/260 |
| 3,381,250 | A * | 4/1968 | Weathers | H01F 7/13 | 335/255 |
| 3,597,622 | A * | 8/1971 | Wilson | H01H 51/065 | 290/37 R |
| 3,735,302 | A * | 5/1973 | Eckert | H01F 7/1607 | 335/262 |
| 3,805,204 | A * | 4/1974 | Petersen | H01F 7/1607 | 335/255 |
| 3,815,060 | A * | 6/1974 | Turnbull | H01H 51/005 | 335/131 |
| 4,482,094 | A * | 11/1984 | Knape | F02M 57/02 | 123/446 |
| 4,533,888 | A * | 8/1985 | Grenier | H01H 50/32 | 335/131 |
| 4,604,600 | A * | 8/1986 | Clark | H01F 7/13 | 335/261 |
| 5,066,980 | A * | 11/1991 | Schweizer | H01F 7/13 | 335/255 |
| 5,123,718 | A * | 6/1992 | Tyler | B60T 8/00 | 303/118.1 |
| 5,651,391 | A * | 7/1997 | Connolly | F15B 13/0405 | 137/454.6 |
| 5,739,599 | A * | 4/1998 | Murai | H01F 7/081 | 310/14 |
| 5,892,194 | A * | 4/1999 | Uotome | H01H 1/34 | 218/68 |
| 7,199,687 | B2 * | 4/2007 | Maruhashi | F02N 15/063 | 335/131 |
| 7,551,049 | B2 * | 6/2009 | Hirabayashi | H01H 51/065 | 335/106 |
| 7,874,541 | B2 * | 1/2011 | Abe | F16K 31/0613 | 137/625.69 |
| 7,876,183 | B2 * | 1/2011 | Uruma | H01H 50/04 | 335/126 |
| 8,390,408 | B2 * | 3/2013 | Nawa | H01H 3/001 | 335/131 |
| 8,446,239 | B2 * | 5/2013 | Niimi | H01H 51/065 | 335/126 |
| 2007/0241847 | A1 | 10/2007 | Yamamoto et al. | | |
| 2009/0002105 | A1 * | 1/2009 | Bradfield | F02N 15/067 | 335/187 |
| 2009/0066450 | A1 * | 3/2009 | Yano | H01H 49/00 | 335/203 |
| 2009/0284335 | A1 | 11/2009 | Kim et al. | | |
| 2009/0322455 | A1 * | 12/2009 | Yoshihara | H01F 7/1615 | 335/189 |
| 2011/0156845 | A1 | 6/2011 | Eum | | |
| 2013/0321107 | A1 * | 12/2013 | Palanisamy | H01H 1/2025 | 335/179 |
| 2014/0184366 | A1 * | 7/2014 | Ito | H01H 50/54 | 335/189 |
| 2015/0054604 | A1 * | 2/2015 | Kubono | H01H 50/36 | 335/177 |
| 2015/0054605 | A1 * | 2/2015 | Kubono | H01H 50/60 | 335/177 |

FOREIGN PATENT DOCUMENTS

| | | |
|---|---|---|
| EP | 1768152 | 3/2007 |
| EP | 2365508 | 9/2011 |
| EP | 2442342 | 4/2012 |
| JP | 59175529 | 10/1984 |
| JP | U4021045 | 5/1992 |
| JP | U05-018005 | 3/1993 |
| JP | U05-083993 | 11/1993 |
| JP | 2003318023 | 11/2003 |
| JP | 2006019148 | 1/2006 |
| JP | 2006310248 | 11/2006 |
| JP | 2013016701 | 1/2013 |
| KR | 10-2007-0027567 | 9/2007 |
| WO | 2006/104080 | 10/2006 |
| WO | 2010/108878 | 9/2010 |

OTHER PUBLICATIONS

Japan Patent Office Patent Application No. 2015-136725, Office Action dated May 10, 2016, 3 pages.
State Intellectual Property Office of the People's Republic of China Application Serial No. 201510390560.7, Office Action dated Jan. 3, 2017, 7 pages.
Japan Patent Office Application No. 2015-136725, Notice of Allowance dated Feb. 7, 2017, 4 pages.

* cited by examiner

MAGNETIC SWITCH

CROSS-REFERENCE TO RELATED APPLICATION

Pursuant to 35 U.S.C. §119(a), this application claims the benefit of earlier filing date and right of priority to Korean Application No. 10-2014-0087645, filed on Jul. 11, 2014, the contents of which is incorporated by reference herein in its entirety.

BACKGROUND OF THE INVENTION

1. Field of the Invention

The present disclosure relates to a magnetic switch.

2. Background of the Invention

A magnet switch is a device used for switching (opening or closing) power of an electric line, and is extensively utilized for industrial, household, and vehicle purposes. In particular, a magnetic switch for a vehicle is used to supply and cut off DC power provided from a storage battery of a vehicle such as a hybrid vehicle, a fuel cell vehicle, or a golf cart.

Such a magnetic switch is closed and a current flows when a stationary contact arm and a movable contact arm are brought into contact with each other, and in particular, in order to control an arc generated when DC power having a high voltage is cut off, a permanent magnet is used. The magnetic switch employs a breaking mechanism in which a permanent magnet is appropriately disposed in the vicinity of a stationary contact arm and a movable contact arm where an arc is generated, and an arc is controlled and cooled to be extinguished using a force determined according to strength and a direction of magnetic flux generated in the permanent magnet, a current direction, and an elongated length of an arc. Here, an arc extinguishing unit and a motor magnet may be damaged by the generated arc, and thus, in order to enhance operational reliability of a magnetic switch, it is required to extinguish the arc and protect the magnetic switch against the arc. The present invention provides enhancement of operational reliability of a high voltage DC switch, and the foregoing requirements are satisfied by using a protecting device formed of a resin material.

FIG. 2 is a view illustrating a related art magnetic switch 100. As illustrated in FIG. 2, the related art magnetic switch includes a moving unit 140 movable with a contact, a gas sealing unit for hermetically sealing an arc-extinguishing gas filling space for arc extinguishment, and a magnetic driving unit providing driving force to drive the moving unit 140. Here, the moving unit includes a shaft 141, a cylindrical movable core 145 connected to a lower portion of the shaft 141 such that the cylindrical movable core 145 can be linearly movable together with the shaft 141, and disposed to be movable linearly by a magnetic pull from the magnetic driving unit, and a movable contact arm 150 connected to an upper end portion of the shaft 141 to form an electrical contact portion. A fixed core 143 is provided in a position facing the movable core 145 and surrounds the shaft 141, and the fixed core 143, the movable core 145, the second barrier 118, and the like, form a circuit providing a path along which magnetic flux moves.

The gas sealing unit is provided in the vicinity of an upper portion of the moving unit to form an arc extinguishing gas chamber in which an arc extinguishing gas of the magnetic switch is airtightly installed (or sealed), and includes a tubular insulating member, a pair of fixed electrodes 121 penetrating through the insulating member to connect the interior and exterior of the insulating member and airtightly coupled to the insulating member, a tubular airtight member provided between the insulating member and a second barrier 118 (to be described hereinafter) to airtightly seal the insulating member and the second barrier 18 and having a step, and a cylinder 160 formed of a non-magnetic material and installed to airtightly surround the movable core 145 and the fixed core 143. Here, a DC power source side and a load side are connected to the pair of fixed electrodes 121 electrically, for example, through an electric line.

The magnetic driving unit for switching the magnetic switch by driving the movable core 145 and the movable contact arm 150 (to be described hereinafter) by generating a magnetic pull includes a magnetizing coil 131 and the second barrier 118. Here, the magnetizing coil 131 is a driving coil provided in a lower portion of the magnetic switch. When a current is applied, the magnetizing coil 131 is magnetized, and when an application of a current is cut off, the magnetizing coil is demagnetized. The magnetizing coil 131 provides driving force to the moving unit for switching (or opening and closing) a contact by generating a magnetic pull in the magnetic switch. The second barrier 118 is installed above the magnetic coil 133, and when the magnetic coil 133 is magnetized, the second barrier 118 forms part of a movement path of magnetic flux, together with the movable core 145 and the fixed core 143. When the magnetic coil 133 is magnetized, a lower yoke forms a movement path of magnetic flux, together with the second barrier 118, the movable core 145, and the fixed core 143.

In FIG. 2, a bobbin 131 may allow the magnetizing coil 133 to be wound therearound, and supports the magnetizing coil 133. A return spring 183 is installed above the shaft 141, and when the magnetizing coil 133 is demagnetized, the return spring 183 provides elastic force to return the movable core 145 to the original position, that is, to a position spaced apart from the fixed core 143. In FIG. 2, a contact spring is a spring for maintaining contact pressure between contacts when the movable contact arm 150 is in an ON position of the magnetic switch in which the movable contact arm 150 is in contact with the fixed electrode 121. In FIG. 1, a housing 110 accommodates the magnetic switch according to the related art.

An operation of the magnetic switch according to the related art configured as described above will be described. When the magnetizing coil 133 is magnetized upon receiving a current, magnetic flux generated by the magnetic coil 133 may move along a movement path of the magnetic flux formed in the movable core 145, the fixed core 143, the second barrier 118, and the lower yoke (not shown), forming a closed circuit of magnetic flux, and at this time, the movable core 145 linearly moves to be brought into contact with the fixed core 143, and at the same time, the shaft 141 connected to be moved together with the movable core 145 moves upwardly. Then, the movable contact arm 150 installed in eh upper end portion of the shaft 141 is brought into contact with the fixed electrode 121 and the DC power source side and the load side are connected to enter an ON state in which DC power is supplied.

When a current supplied to the magnetizing coil 133 is cut off, the magnetizing coil 133 is demagnetized, and as the magnetizing coil 133 is demagnetized, the movable core 145 is returned to the original position spaced apart from the fixed core 143, by the return spring 183. Accordingly, the shaft 141 connected to be moved together with the movable core 145 moves downwardly. Then, the movable contact arm 150 installed in the upper end portion of the shaft 141 is separated from the fixed electrode 121, entering an OFF state in which the DC power source side and the load side are separated and supply of the DC power is cut off.

When power is applied through a coil terminal, magnetic force is formed in a coil assembly and the movable core 145 moves to push up the shaft in a direction toward the fixed core. Here, short-circuit performance (operational performance) of the magnetic switch is determined by compressive force of the two types of springs when the magnetic switch is turned on, and, in general, since a load of the contact spring 181 is considerably large, compared with the return spring 183, short-circuit performance of the magnetic switch relies on maximum compressive force of the contact spring. Compressive force of a spring is proportional to a maximum compression distance, and is determined by a distance between the fixed core and the movable core 145 and a distance between the fixed contact arm and the movable contact arm.

In general, short-circuit performance according to current capacity of a magnetic switch is determined according to maximum compressive force of the contact spring 181. In the related art, maximum compressive force of a spring is proportional to a compression distance of the spring, it is not easy to enhance compressive force of the spring in a limited space such as in the related art.

SUMMARY OF THE INVENTION

Therefore, an aspect of the detailed description is to provide a magnetic switch having short-circuit performance enhanced by changing a shape of a movable core.

To achieve these and other advantages and in accordance with the purpose of this specification, as embodied and broadly described herein, a magnetic switch may include: a housing; a cylinder coupled to an inner side of the housing; a stationary contact arm coupled to the housing; a movable contact arm positioned to be movable within the housing and brought into contact with the stationary contact arm or separated therefrom; a coil assembly installed within the housing and configured to form a magnetic field when a current is applied thereto; a movable shaft coupled to the movable contact arm in an upper portion thereof; a fixed core inserted into the cylinder and surrounding the movable shaft; and movable cores fixed to the movable shaft and configured to press the movable shaft by a magnetic field formed by the coil assembly to move the movable shaft, wherein the movable cores include protrusion portions extending toward the movable shaft and fixed to the movable shaft and body portions configured to move in contact with an inner diameter of the cylinder, and the fixed core has an accommodation portion for accommodating the protrusion portions.

The protrusion portion and the body portion may be provided as separate members.

The magnetic switch may further include: a contact spring configured to provide elastic force to the movable shaft such that the movable contact arm moves in a direction in which the movable contact arm is brought into contact with the stationary contact arm; and a return spring configured to provide elastic force to the movable shaft such that movable contact arm moves in a direction in which the movable contact arm is separated from the stationary contact arm.

The protrusion portions may press a lower end of the movable shaft, and as the movable shaft is pressed by the protrusion portion, the movable shaft may be guided by the fixed core so as to be moved.

Outer surfaces of the protrusion portions may be in contact with an inner surface of the accommodation portion and guided to be moved.

After a current is applied to the coil assembly, the body portion and the protrusion portion may press the movable shaft together to move the movable shaft, and thereafter, the protrusion portion may be spaced apart from the body portion by a predetermined distance to further press the movable shaft and move within the accommodation portion.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Description will now be given in detail of the exemplary embodiments, with reference to the accompanying drawings. For the sake of brief description with reference to the drawings, the same or equivalent components will be provided with the same reference numbers, and description thereof will not be repeated.

Hereinafter, a magnetic switch according to an embodiment of the present disclosure will be described in detail with reference to the accompanying drawings. Parts of the magnetic switch similar to those of the related art will be briefly described within a range required for describing the characteristics of the present disclosure.

Figure 1:
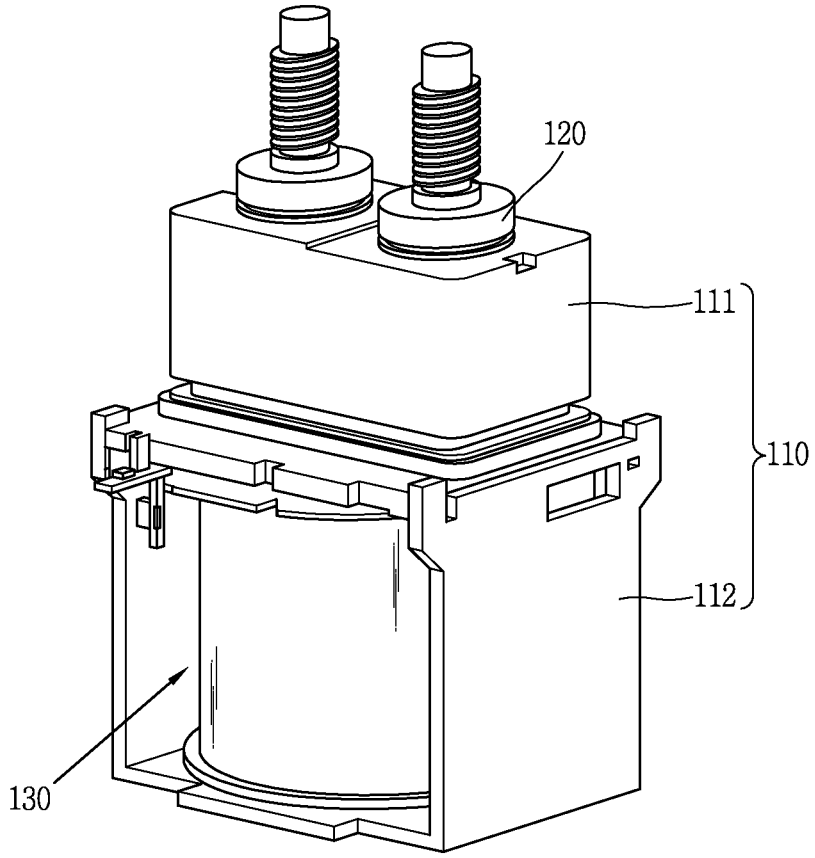
FIG. 1 RELATED ART
FIG. 1 is a perspective view of the related art magnetic switch.
Figure 2:
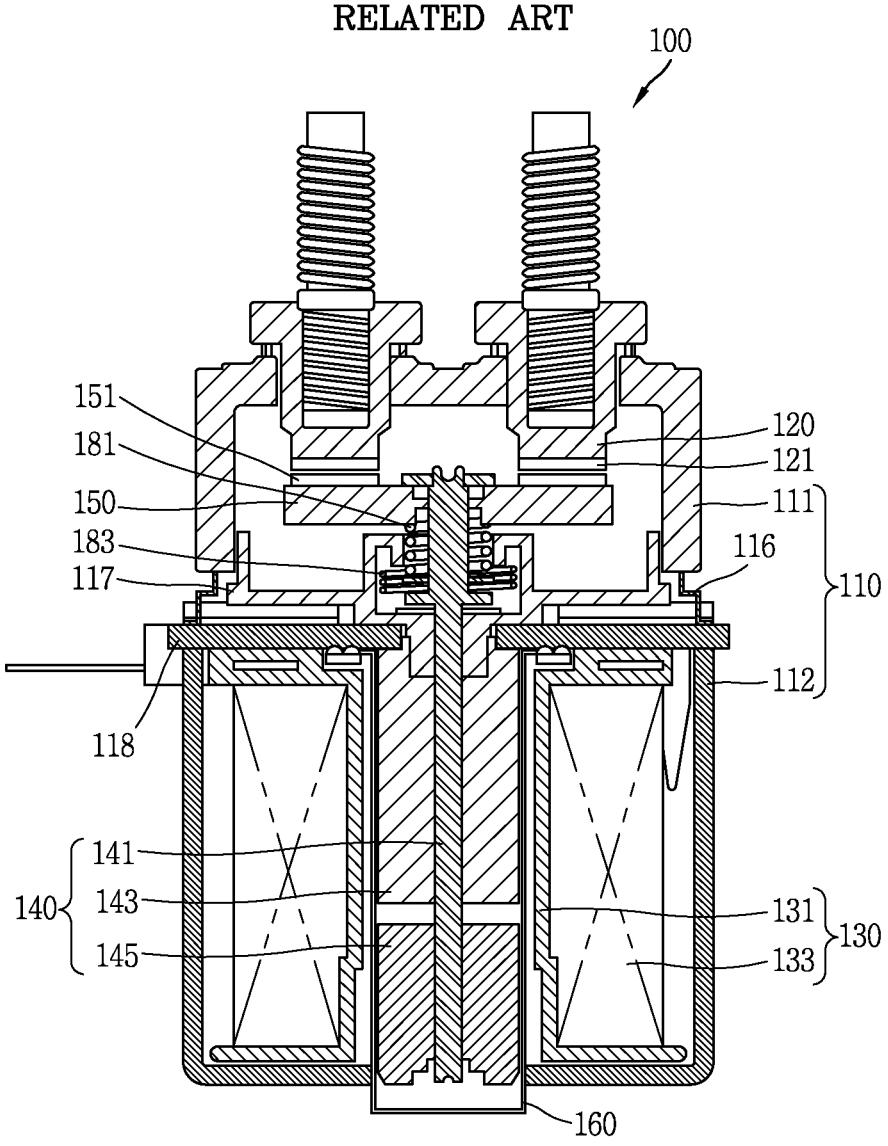
FIG. 2 RELATED ART
FIG. 2 is a cross-sectional view of the related art magnetic switch.
Figure 3:
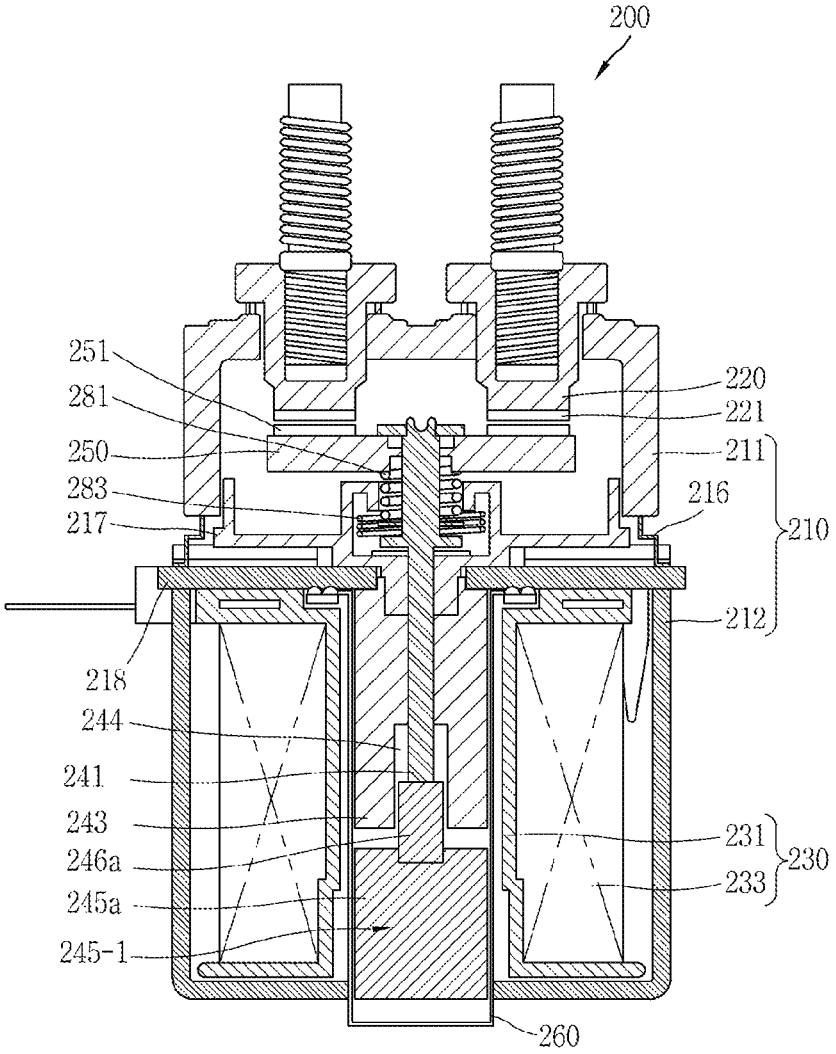
FIG. 3 is a cross-sectional view of a magnetic switch according to an embodiment of the present disclosure.

FIG. 3 is a cross-sectional view of a magnetic switch 200 according to an embodiment of the present disclosure. As illustrated in FIG. 3, a movable shaft 241 is positioned to be movable within a housing 210, and a movable contact arm 250 is coupled to an upper portion of the movable shaft 241. Accordingly, when movable cores 245-1 and 245-2 presses the movable shaft 241 and moves the movable shaft 241, the movable shaft 241 and the movable contact arm 250 move together and the movable contact arm 250 is brought into contact with the stationary contact arm 220.

The movable cores 245-1 and 245-2 are positioned within a cylinder 260, and when a current is applied to a coil assembly, generated magnetic force is transferred to the movable cores 245-1 and 245-2. Upon receiving the magnetic force, the movable cores 245-1 and 245-2 press the movable shaft 241 to move it.

The movable cores 245-1 and 245-2 include body portions 245*a* and 245*b* and protrusion portions 246*a* and 246*b*, respectively. The protrusion portion 246*a* or 246*b* protrudes toward the fixed core 243. The body portions 245*a* and 245*b* may be in contact with an inner side of the cylinder 260 and movable by a magnetic force. The protrusion portion 246*a* or 246*b* is fixed to a lower end of the movable shaft 241 by welding. The protrusion portions 246*a* and 246*b* of the movable cores 245-1 and 245-2 may be integrally manufactured with the movable cores 245-1 and 245-2, or the protrusion portions 246*a* and 246*b* may be assembled, as separate components, to the body portions 245*a* and 245*b* of the movable cores 245-1 and 245-2, respectively. As described hereinafter, the body portion 245*a* or 245*b* and the protrusion portion 246*a* or 246*b* may move together to press the movable shaft 241, and thereafter, the protrusion portion 246*a* or 246*b* may be separated from the body portions 245*a* and 245*b* by a predetermined distance, respectively, to further press the movable shaft 241.

The fixed core 243 is fixed to the cylinder 260 and has a hole formed in a length direction to guide and move the movable shaft 241 as described hereinafter.

The fixed core 243 may include an accommodation portion 244. The accommodation portion 244, a space for accommodating the protrusion portion 246*a* or 246*b*, may be provided to be larger than the protrusion portion 246*a* or 246*b*. An outer side of the protrusion portion 246*a* or 246*b* may be in contact with an inner side of the accommodation portion 244. A depth of the accommodation portion 244 may be greater than or equal to a length of the protrusion portion 246*a* or 246*b* such that the protrusion portion 246*a* or 246*b* may sufficiently move to the inner side of the accommodation portion 244 so as to be accommodated therein.

Referring to FIG. 3, a contact spring 281 and a return spring 283 are positioned above the movable shaft 241. The contact spring 281 applies elastic force to the movable shaft 241 such that the movable contact arm 250 is brought into contact with the stationary contact arm 220, and maintains contact pressure between contacts when the movable contact arm 250 and the stationary contact arm 220 are in a position where they are in contact. The contact spring 281 is pressed between the movable contact arm 250 and a first rib of the movable shaft 241 so as to be elastically deformed.

The return spring 283 applies elastic force to the movable shaft 241 such that the movable contact arm 250 is separated from the stationary contact arm 220. The return spring 283 is pressed between a second rib (not shown) of a first barrier 217 and a washer positioned in the movable shaft 241 so as to be elastically deformed.

The magnetic switch includes the housing 210, and the housing 210 may include a first housing 211 and a second housing 212.

The first housing 211 is positioned in an upper portion of the magnetic switch, coupled to the first barrier 217, and divide the upper portion of the magnetic switch into an arc extinguishing region in which the stationary contact arm 220 and the movable contact arm 250 come into contact and the other remaining region. The first housing 211 may be formed of a ceramic material for an insulation purpose. A pair of stationary contact arms 220 penetrate through an upper surface of the first housing 211 and airtightly coupled to the first housing 211.

The second housing 212 is positioned in a lower portion of the magnetic switch and may be coupled to a second barrier 218. The cylinder 260 is coupled to an actuator region formed by the second housing 212 and the second barrier 218, and a coil assembly is installed around the cylinder 260.

Hereinafter, an operation of an embodiment of the magnetic switch according to the present disclosure will be described in detail.

First, in a state in which a current is not applied to the coil assembly 230, only elastic force of the return spring acts on the movable shaft 241. Thus, the movable shaft 241 is maintained in a state of having moved downwardly, and accordingly, the movable contact arm 250 is separated from the stationary contact arm 220.

Meanwhile, when a current is applied to the coil assembly 230 so the coil 233 is magnetized, magnetic flux is generated by the movable core 245-1 or 245-2, the fixed core 243, and the second barrier 218, forming a closed circuit of magnetic flux, and accordingly, the movable core 245-1 or 245-2 moves. The movable core 245-1 or 245-2 presses the movable shaft 241. The movable cores 245-1 and 245-2 include the body portions 245*a* and 245*b* and the protrusion portions 246*a* and 246*b*, and as illustrated in FIGS. 4 through 6, the movable core 245-1 or 245-2 presses the movable shaft 241.

Figure 4:
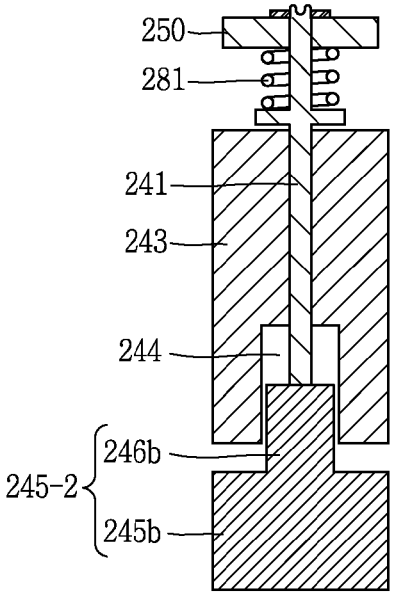
FIG. 4 is a cross-sectional view of a moving unit according to an embodiment of the present disclosure.

In FIG. 4, the movable core 245-2 in which the protrusion 246*b* and the body portion 245*b* are integrated is illustrated, illustrating an embodiment in which the movable core 245-2 presses the movable shaft 241. Here, pressing starts to compress the contact spring 281.

Figure 5:
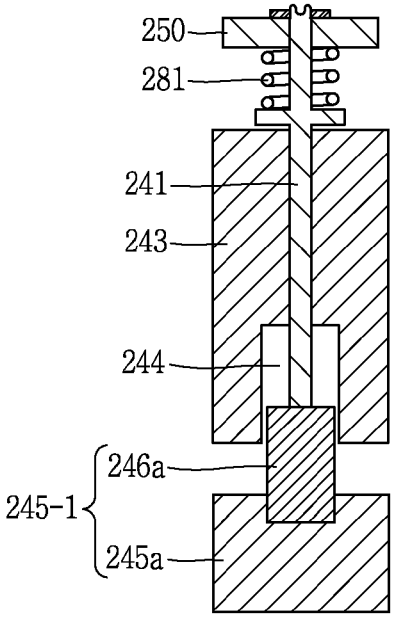
FIG. 5 is a cross-sectional view of a moving unit according to another embodiment of the present disclosure.

In FIG. 5, the movable core 245-1 in which the protrusion portion 246*a* and the body portion 245*a* are separated is illustrated, illustrating another embodiment in which the movable core 245-1 presses the movable shaft 241. Here, pressing starts to compress the contact spring 281.

Figure 6A:
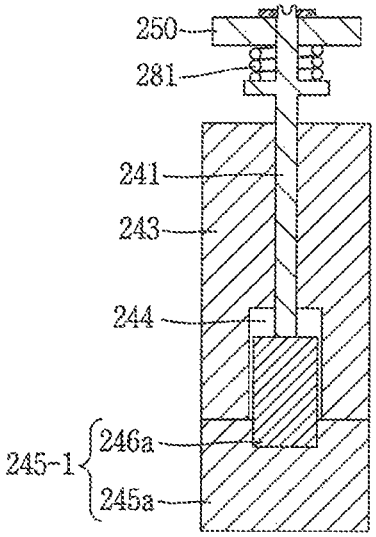
FIGS. 6A and 6B are cross-sectional views of the moving unit according to the embodiment of FIG. 5.

In FIG. 6A, the protrusion portion 246*a* and the body portion 245*a* press the movable shaft 241 so the movable shaft 241 is moved upwardly. Here, the body portion 245*a* moves to a position as close as possible to the fixed core 243, in a state of pressing the movable shaft 241. The contact spring 281 is more compressed than that of FIG. 5.

Figure 6B:
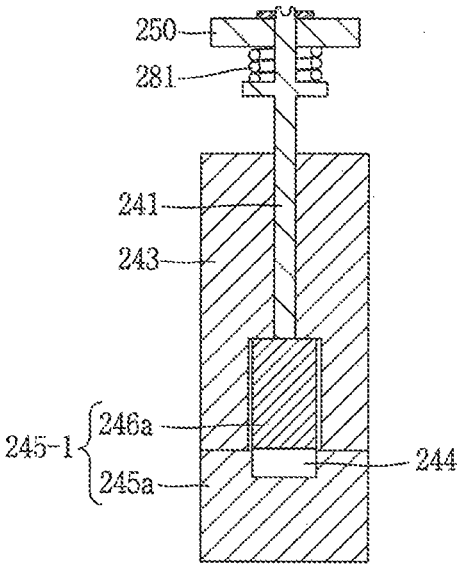

In FIG. 6B, the protrusion portion 246*a* may be separated from the body portion by a predetermined distance to further press the movable shaft 241. The contact spring 281 is compressed as much as possible to enhance short-circuit performance of the fixed contact arm 220 and the movable contact arm 250. The protrusion portion may be coupled to the body portion by a spring, and the protrusion portion may be separated from the body portion to further press the movable shaft, and here, a control unit for controlling this operation may be further provided.

Figure 7:
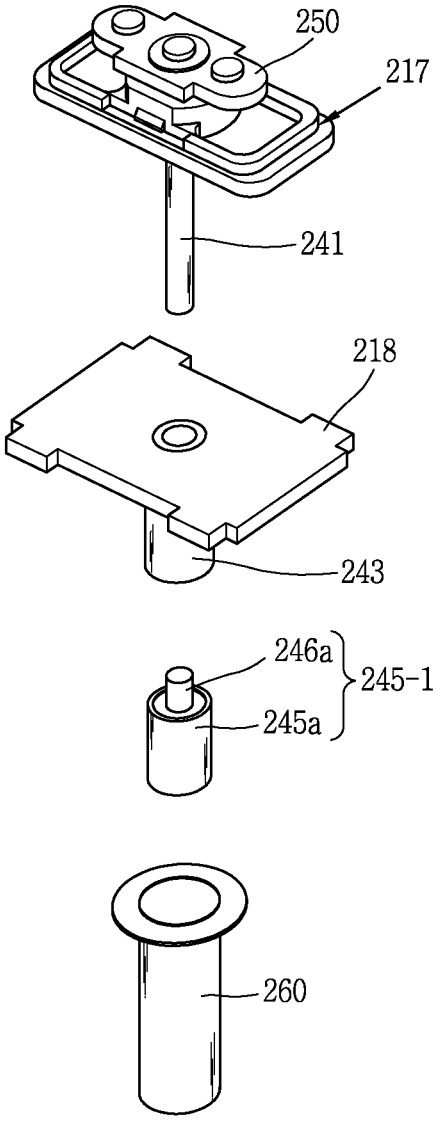
FIG. 7 is an exploded perspective view of the moving unit according to the embodiment of FIG. 5.

FIG. 7 is an exploded perspective view illustrating the movable contact arm 250, the first barrier 217, the movable shaft 241, and the movable core 245-1 or 245-2. These components are assembled and exploded as illustrated.

When a current supplied to the magnetic coil 233 is cut off, the movable core 245-1 or 245-2 is returned to the original position spaced apart from the fixed core 243 by the return spring 283. Then, an OFF state is entered in which the movable contact arm 250 installed in an upper end portion of the movable shaft is separated from the fixed contact arm 220.

According to an embodiment of the present invention, the movable cores 245-1 and 245-2 include the protrusion portions 246*a* and 246*b*, respectively, the fixed core 243 includes the accommodation portion, and the protrusion portions 246*a* and 246*b* of the movable cores 245-1 and 245-2 press the movable shaft within the accommodation portion and are moved, whereby a maximum compression distance of the contact spring 281 increases and short-circuit performance of the magnetic switch may be enhanced.

The foregoing embodiments and advantages are merely exemplary and are not to be considered as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

What is claimed is:

1. A magnetic switch comprising:

a housing;

a cylinder coupled to an inner side of the housing;

a stationary contact arm coupled to the housing;

a movable contact arm positioned to be movable within the housing and brought into contact with the stationary contact arm or separated therefrom;

a coil assembly installed within the housing and configured to form a magnetic field when a current is applied thereto;

a movable shaft coupled to the movable contact arm in an upper portion thereof;

a fixed core inserted into the cylinder and surrounding the movable shaft; and movable cores fixed to the movable shaft and configured to press the movable shaft by a magnetic field formed by the coil assembly to move the movable shaft, wherein the movable cores include a protrusion portion extending toward the movable shaft and fixed to the movable shaft and a body portion configured to move in contact with an inner diameter of the cylinder, and the fixed core has an accommodation portion for accommodating the protrusion portion, wherein the protrusion portion and the body portion are provided as separate members, wherein the protrusion portion presses a lower end of the movable shaft when the body portion and the protrusion portion move together, and as the movable shaft is pressed by the protrusion portion, the movable shaft is guided by the fixed core so as to be moved, and wherein the protrusion portion is separated from the body portion such that the separated protrusion portion further presses the movable shaft.

2. The magnetic switch of claim 1, wherein an outer surface of the protrusion portion is in contact with an inner surface of the accommodation portion and guided to be moved.

3. The magnetic switch of claim 1, wherein a depth of the accommodation portion is greater than a height of the protrusion portion such that the protrusion portion is accommodated within the accommodation portion.

4. The magnetic switch of claim 1, wherein the body portion separated from the protrusion portion does not move when the separated protrusion portion moves alone to press the movable shaft.

5. The magnetic switch of claim 4, wherein a moving distance of the protrusion portion is greater than a moving distance of the body portion when the movable shaft is pressed.

6. The magnetic switch of claim 1, wherein the separated protrusion portion moves further to press the movable shaft while the body portion contacts the fixed core and cannot move further.

* * * * *